United States Patent [19]

Hagelthorn

[11] 4,165,529

[45] Aug. 21, 1979

[54] LAMP SHADE AND KNOCK-DOWN KIT FOR FORMING SAME

[76] Inventor: Allan Hagelthorn, 66 E. 80 St., New York, N.Y. 10021

[21] Appl. No.: 871,555

[22] Filed: Jan. 23, 1978

[51] Int. Cl.[2] ..... F21V 1/06

[52] U.S. Cl. ..... 362/352; 362/358; 362/357

[58] Field of Search ..... 362/352, 353, 358, 360

[56] References Cited

U.S. PATENT DOCUMENTS

| | | | |
|---|---|---|---|
| 1,072,815 | 9/1913 | Brady | 362/352 |
| 1,335,640 | 3/1920 | Beales | 362/352 |
| 3,435,205 | 3/1969 | Paul | 362/352 |
| 3,689,762 | 9/1972 | Shatan | 362/352 X |
| 3,764,801 | 10/1973 | Mainieks | 362/352 |
| 4,079,245 | 3/1978 | Baker | 362/352 X |

FOREIGN PATENT DOCUMENTS

| | | | |
|---|---|---|---|
| 31714 | 9/1964 | German Democratic Rep. | 362/352 |

*Primary Examiner*—Peter A. Nelson

*Attorney, Agent, or Firm*—Kirschstein, Kirschstein, Ottinger & Cobrin

[57] ABSTRACT

A ready-to-assemble knock-down kit for forming a lamp shade and analogous articles includes a plurality of panels, preferably of flexible non-self-supporting material such as cloth, and a plurality of longitudinally-extending ribs for snappingly engaging adjacent side edge regions of each two adjacent panels. Each rib has resilient wall portions which bound a generally U-shaped channel for receiving therein with snap-type action a side edge region of one panel and a side edge region of another adjacent panel. The panels are supported in a predetermined lamp shade type orientation relative to each other by a plurality of support elements which extend radially outwardly from a ring member that is adapted to be mounted on a lamp to be shaded. Each support element has one end turnably mounted in the ring member and another end mountable on a respective rib. The other end is receivable either directly in the channel of the respective rib or in an auxiliary channel formed in an extension of the rib. The shade is assembled from a plurality of parts which are shipped in a generally flat, compact or collapsed condition.

12 Claims, 7 Drawing Figures

FIG. 1
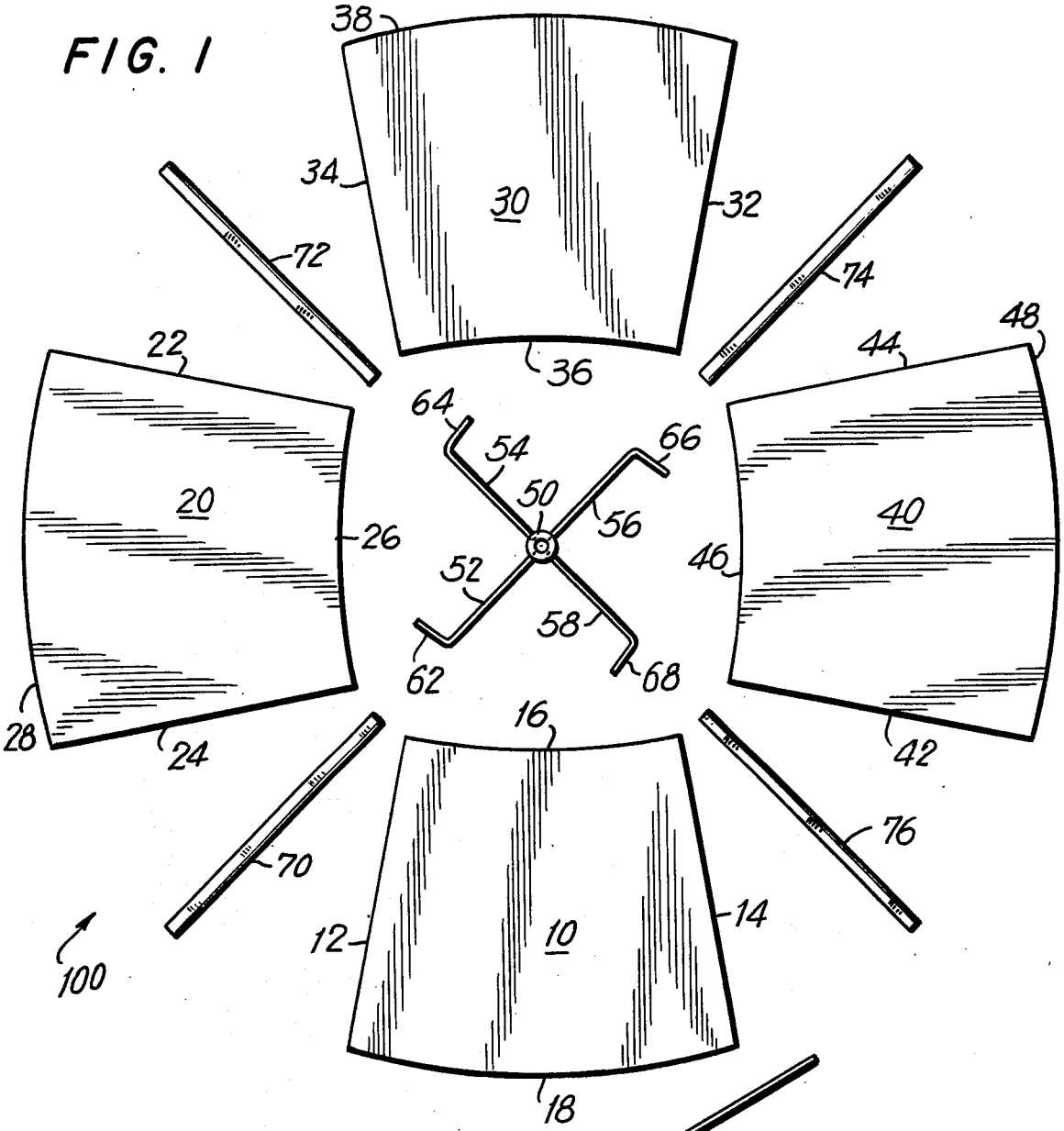
FIG. 2
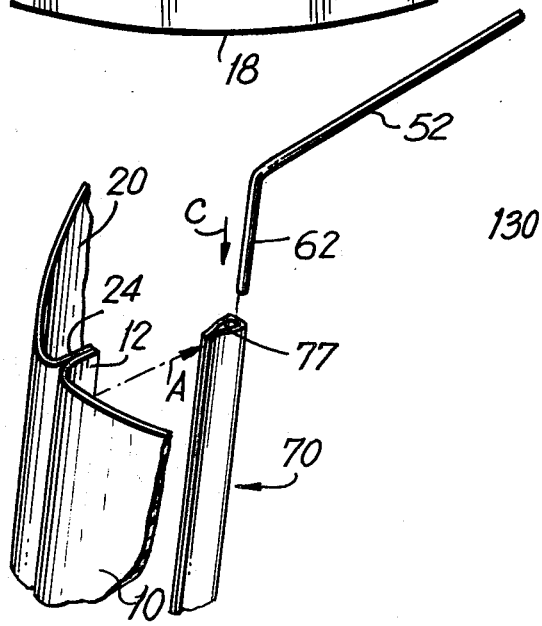
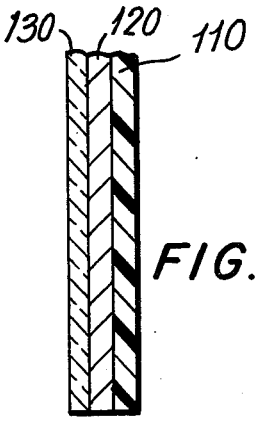
FIG. 7

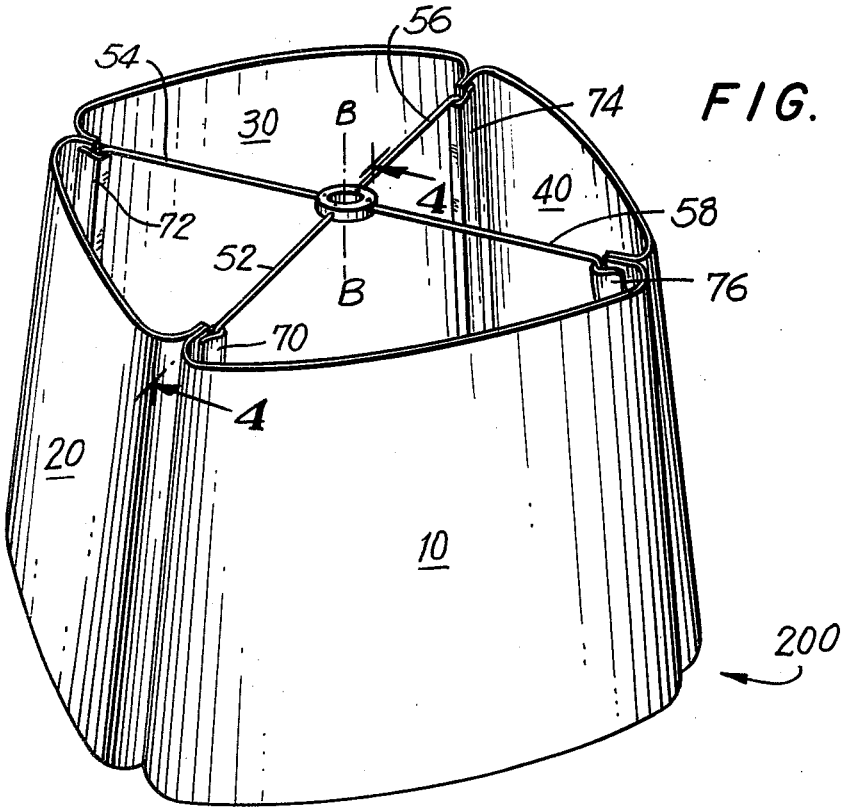
FIG. 3
FIG. 4
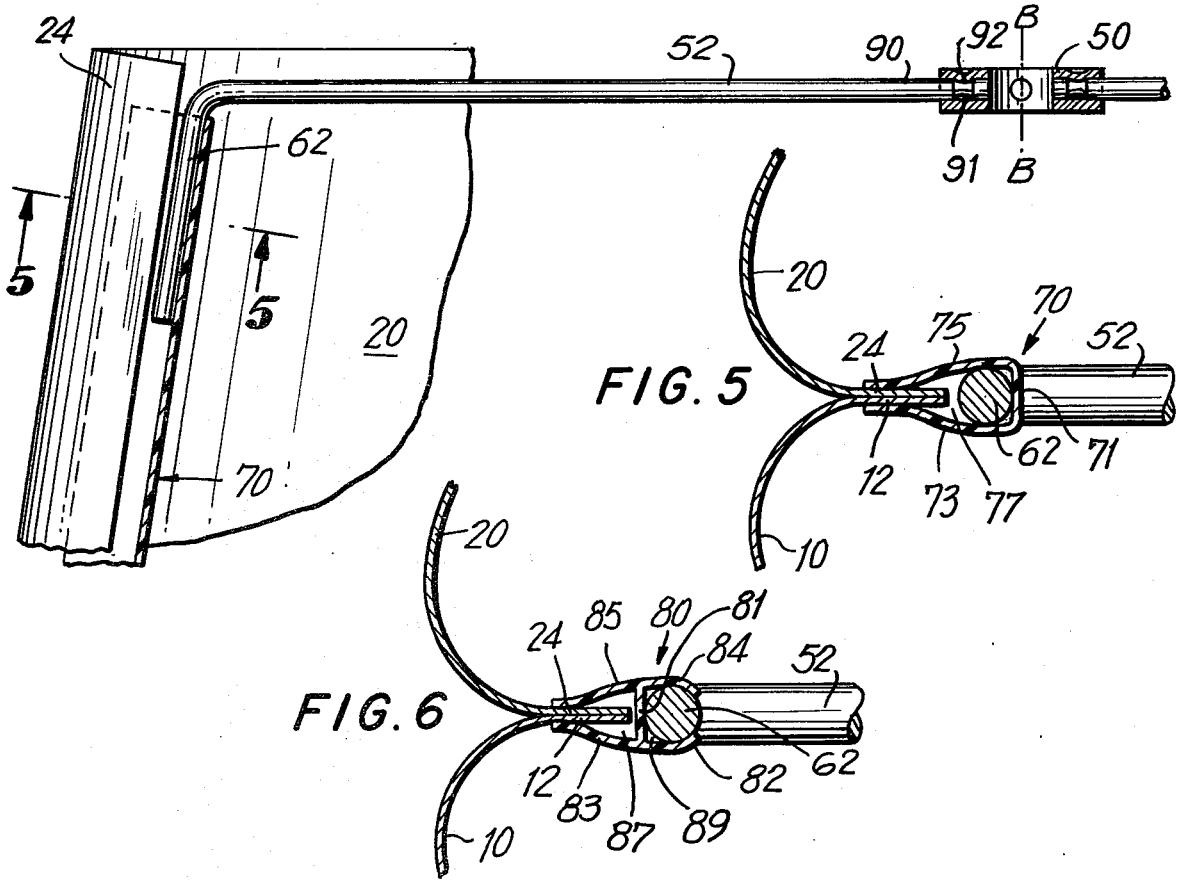
FIG. 5
FIG. 6

LAMP SHADE AND KNOCK-DOWN KIT FOR FORMING SAME

BACKGROUND OF THE INVENTION

1. Field of the Invention

The present invention relates generally to an improved lamp shade construction and, more particularly, to a knock-down kit for forming a lamp shade from a plurality of ready-to-assemble parts which are shipped in a generally flat, compact or collapsed condition.

2. Description of the Prior Art

It has earlier been proposed to fully assemble lamp shades prior to shipment. Such lamp shades require a considerable amount of storage space and shipment space, particularly in cases where the fully assembled lamp shade cannot be easily nested or stacked, for example, when the lamp shades have a cylindrical configuration. In order to reduce the amount of space required for storage and/or shipment and the concomitant high shipping costs associated therewith, it has also been proposed to construct a ready-to-assemble or a knock-down lamp shade which can be compactly packaged in collapsed condition for facilitating storage and/or shipment and for reducing storage and shipping costs.

Although the known collapsible lamp shade kits are generally acceptable for their intended purpose, they have not proven to be altogether satisfactory in use. Such prior art kits have proven to be very difficult for an ordinary purchaser to assemble. Moreover, the assembly of the known prior art kits by a retailer prior to sale has also proven to be a time consuming, complex and expensive task. Furthermore, the prior art kits construct their lamp shades of rigid material such as glass or plastic. Such rigid panels are easily scratched and, once broken, are expensive to replace.

SUMMARY OF THE INVENTION

Objects of the Invention

Accordingly, it is the general object of the present invention to overcome the drawbacks of the prior art.

Another object of the present invention is to provide an improved lamp shade kit which is quick and easy to assemble.

A further object of the present invention is to provide an improved lamp shade kit which can be shipped in a compact collapsed condition such that a mimimum amount of storage and/or shipping space is required.

Still another object of the present invention is to provide an inexpensive and aesthetic collapsible shade.

An additional object of the present invention is to provide for quick and easy interchange of non-rigid, non-selfsupporting, flexible material panels.

Brief Description of the Invention

In keeping with these objects and others which will become apparent hereinafter, one feature of the invention resides, briefly stated, in a knock-down kit for forming a lamp shade and other analogous articles which comprises a plurality of panels each having opposed longitudinally-extending side edge regions, and means for snappingly engaging adjacent side edge regions of each two adjacent panels. The snap-type means includes a plurality of longitudinally-extending ribs. Each rib has resilient wall portions which bound a generally U-shaped channel for receiving therein with snap-type action a side edge region of one panel and a side edge region of another adjacent panel. The knock-down kit further includes means for supporting the panels in a predetermined lamp shade type orientation relative to each other. The supporting means includes a ring member for attaching the lamp shape to the lamp to be shaded, and a plurality of support elements each of which extends radially outwardly from the ring member. Each support element has one end turnably mounted in the ring member and another end mountable on a respective rib. The above-described parts are easily assembled from a flat, compact or collapsed condition to the final fully assembled lamp shade configuration.

In accordance with the invention, the resilient walls of each rib snappingly and reliably engage adjacent side edge regions of each two adjacent panels. The ribs thus serve as clips and provide an especially quick and easy to assemble lamp shade which can be assembled and errected by even the most unskilled user. The ribs further provide an especially attractive and aesthetic appearance which stimulates the acceptance and purchase of the lamp shade kit by the public. The usage of a minimum amount of space for storage and shipment is assured by the packing of all of the above-described parts in a generally flat compact package.

The ribs also permit the plurality of panels to be quickly and easily interchanged with one another. In a preferred embodiment, the panels are constituted by non-rigid flexible material such as cloth. In the event that one panel is damaged, it is relatively simple for a user to disassemble the lamp shade and replace the damaged panel with a fresh one. In certain cases, the various panels may be differently colored. A user can select which colored panel he desires in dependence upon his personal taste. Panels fabricated of cloth are particularly inexpensive to replace as compared with glass, plastic or other panels constituted by rigid material.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a top plan view of a lamp shade kit in flat, collapsed, disassembled condition in accordance with the present invention;

FIG. 2 is a fragmentary and perspective view diagrammatically showing the method of assembling various parts of the lamp shade kit of FIG. 1;

FIG. 3 is a perspective view of the lamp shade kit of FIG. 1 in fully assembled condition;

FIG. 4 is a partial view in vertical section taken along line 4—4 of FIG. 3;

FIG. 5 is a sectional view as taken along line 5—5 of FIG. 4 and shows a preferred cross-sectional configuration for the ribs of the lamp shade kit;

FIG. 6 is a view analogous to FIG. 5 and shows a modification of the cross-sectional configuration for the ribs of the lamp shade kit.

FIG. 7 is a sectional view of a modified panel.

DESCRIPTION OF THE PREFERRED EMBODIMENTS

Referring now to the drawings, FIG. 1 illustrates in top plan view the major parts of a multi-part ready-to-assemble knock-down kit for forming a lamp shade. The illustrated parts are shown in generally flat, collapsed, disassembled condition and are oriented relative to each other not in the manner in which they are customarily stored, packaged or shipped, but instead in a manner which indicates their proper orientation for assembly purposes. Articles other than lamp shades, such as waste baskets, may likewise be assembled according to the present invention. For ease of description, the knock-down kit will be described in connection with the construction of lamp shades.

However, it will be expressly understood that the following disclosure is not intended to be limited solely to lamp shade constructions but includes the formation of other analogous articles.

The knock-down kit 100 of FIG. 1 comprises a plurality of panels 10, 20, 30, 40 which serves as the shade members. The panels are preferably constituted by any suitable soft, bendable, flexible, non-rigid, non-self-supporting material such as light-weight paper or light fabric material, or by any suitable semirigid but still bendable material such as heavy-weight paper, parchment, thin plastic or stiffened fabric material. In some cases the panels may be constituted by a rigid material such as glass or heavy-weight synthetic plastic material. Of course, all the panels need not be constituted of the same material for the same application. It is possible that different panels may be constituted of different materials in accordance with the aesthetic design and tastes of a user.

The panels are preferably generally rectangular in shape, as illustrated, or may be of numerous other shapes such as square, trapezoidal, conical, frusto-conical, etc.

Panel 10 has a pair of opposed longitudinally-extending side edge regions 12, 14 and another pair of opposed transversely-extending end edge regions 16, 18. In analogous manner, panels 20; 30; 40 have side edge regions 22, 24; 32, 34; 42, 44, respectively and also have end edge regions 26, 28; 36, 38; 46, 48.

The knock-down kit 100 further includes a plurality of longitudinally-extending ribs or clips or edge binders 70, 72, 74, 76 operative for snappingly engaging adjacent side edge regions of each two adjacent panels. As best shown in FIG. 5 for the exemplary rib 70, rib 70 has a pair of opposite resilient side wall portions 73, 75 and a spine or base wall portion 71 extending between the side wall portions. All of these wall portions 71, 73, 75 together bound a generally U-shaped channel 77 operative for receiving therein with snap-type action a side edge region of one panel (e.g., side edge region 12 of panel 10) and a side edge region of another adjacent panel (e.g., side edge region 24 of panel 20). In analogous manner, ribs 72, 74, 76 have similar side and base wall portions.

The ribs are constituted by any resilient material, synthetic plastic material being preferred. Side wall portions 73, 75 are urged by their own inherent resilience towards each other and may but need not touch each other at their free tips or border end regions at the end of the rib which is opposite to spine 71.

The knock-down kit 100 still further includes a mounting ring or ring member 50 having a vertical axis of symmetry B—B, and a plurality of rod-like support elements 52, 54, 56, 58. Mounting ring 50 facilitates positioning of the lamp shade upon a mounting structure (not shown) of a lamp to be shaded, such as a table lamp. The support elements 52, 54, 56, 58 extend radially outwardly from the axis B—B of the ring member 50 and are equiangularly spaced about the periphery of the ring member 50. As best shown in FIG. 4, support element 52 has one end region 90 turnably mounted in ring 50. An annular groove 91 is formed about end region 90, and a portion of ring member 50 of deformed to form an integral projection 92 which extends in axial direction into annular groove 91. A separate set screw or analogous member could be employed as a substitute for the integral projection 92. Essentially, this construction assures that support element 52 may rotate about its longitudinal axis, and that the support element 52 cannot be easily removed from ring 50.

The opposite end region or hook 62 of support element 52 extends generally normally of support element 52, and preferably extends at an obtuse angle thereto. The turning movement of support element 52 allows the hook 62 to be moved from its FIG. 1 position in which hook 62 and support element 52 lie generally in a horizontal plane which extends normally of axis B—B, to its FIG. 4 position in which hook 62 and support element 52 lie generally in a vertical plane which extends in direction of axis B—B.

In analogous manner, support elements 54, 56, 58 are identical in structure and operation to that already described in connection with support element 52. Hooks 64, 66, 68 all extend generally normally, but preferably at an obtuse angle, relative to their respective support elements.

FIG. 2 best shows the method of assembling the various parts of the knock-down kit to form a lamp shade. The side edge regions of each two adjacent panels, e.g., side edge regions 12 and 24 of panels 10 and 20, are bent or flexed inwardly so that side edge regions 12, 24 overlap each other along their entire lengths. The overlapped side edge regions 12, 24 are thereupon inserted together in direction of arrow A through the openable end of rib 70 which is remote from spine 71. The resilient side wall portions 73 and 75, which are normally biased towards each other due to the inherent resilience of the rib 70, are now forced apart to thereby permit entry of the overlapped side edge regions 12, 24 into the channel 77. FIG. 5 best shows the overlapped side edge regions 12, 24 fully clamped within rib 70 by the side wall portions 73, 75.

After the hook 62 has been rotated from its position generally normally of axis B—B to its position generally parallel to axis B—B, the hook 62 is inserted in direction of arrow C into the channel 77 wherein it is received with snap-type action. FIG. 5 again best shows the hook 62 fully clamped within rib 70 by frictional interference with resilient side wall portions 73, 75.

The assembly procedure thus described for support element 52, rib 70, and side edge portions 12 and 24 is repeated for the other support elements, ribs, and side edge portions. The fully assembled lamp shade 200 is illustrated in FIG. 3. It will be noted that the number of panels, ribs and support elements need not be limited to four as illustrated, but an arbitrary number of such panels may be employed according to the particular application and design desired.

FIG. 6 shows a modified cross-section for the ribs. Modified rib 80 comprises a pair of resilient side wall portions 83, 85 which are analogous in structure and function to side wall portions 73 and 75; and base wall portion or spine 81 which is analogous in structure and function to base wall portion 71. Modified rib 80 further comprises auxiliary side wall portions or extension portions 82, 84 which are located on the opposite side of spine 81. Side wall portions 83, 85 and spine 81 together bound a generally U-shaped channel 87 which is analogous in function to the aforementioned channel 77. Extension portions 82, 84 and spine 81 together bound an auxiliary generally U-shaped channel 89. Auxiliary channel 89 is analogous in function to the aforementioned channel 77 and is operative for receiving therein with snap-type action the hook 62 of the support element 52.

It will be understood that each of the elements described above, or two or more together, may also find a useful application in other types of constructions differing from the types described above.

For example, each panel need not be a single sheet, but may constitute a plurality of juxtaposed sheets which are sandwiched together. As shown in sectional view in FIG. 7, three sheets 110, 120, 130 overlap each other to form a multi-layered sandwich panel.

Sheet 130 is the outermost sheet as considered in direction away from the light source to be shaded. Sheet 130 is of clear transparent material, preferably a clear synthetic plastic material.

Sheet 110 is the innermost sheet which is closest relative to the light source, and serves as a backing or support sheet. Sheet 110 is of white translucent material, preferably paper or synthetic plastic translucent material.

Sheet 120 is mounted between sheets 110 and 130, and serves as a display article. Article 120 may be any sheet-like material having indicia which is desired to be displayed by rear illumination, e.g., a negative or positive print, wallpaper, fabric material, contact paper, colored paper, colored or transparent synthetic plastic gels or acetates, etc.

It will be apparent that article 120 is interchangeably mounted between sheets 110 and 130 to thereby permit different articles to be displayed. The overlapped sandwich side regions are received in the ribs as described above in connection with the single sheet panel.

While the invention has been illustrated and described as embodied in a lamp shade and knock-down kit for forming same, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. A knock-down kit for forming a lamp shade and analogous articles, comprising:

(a) a plurality of panels each having opposed longitudinally-extending side edge regions;

means for snappingly engaging adjacent side edge regions of each two adjacent panels, including a plurality of longitudinally-extending ribs each having a pair of wall portions bounding a generally U-shaped channel, at least one of said wall portions of each rib being resilient and movable away from the other of said wall portions of the respective pair, in response to insertion of a panel side edge region into an associated channel, between a non-clamped position, and a clamped position in which said wall portions of each pair receive therebetween with snap-type closure action a side edge region of one panel and a side edge region of another adjacent panel; and (c) means for supporting said snappingly-engaged panels in a predetermined assembled orientation relative to each other, including a plurality of support elements each mountable on a respective rib to thereby form a lamp shade.

2. The knock-down kit of claim 1, wherein each panel is constituted by non-rigid, flexible material.

3. The knock-down kit of claim 1, wherein each rib has a pair of opposed resilient side wall portions and a base wall portion intermediate the latter.

4. The knock-down kit of claim 3, wherein said side wall portions of each pair depend in predetermined direction away from said base wall portion, and converge towards each other along said direction from said non-clamped position in which said respective side wall portions are spaced further apart from each other to said clamped position in which said respective side wall portions are spaced closer together to each other.

5. The knock-down kit of claim 1, wherein said pair of wall portions of each rib have longitudinally-extending border regions which are normally substantially contiguous relative to each other and which are urged apart of each other when the side edge regions of each two adjacent panels are inserted in the respective channel.

6. The knock-down kit of claim 1, wherein said supporting means includes a ring member for attaching the lamp shade to the lamp to be shaded, and wherein said support elements extend radially of and are equiangularly spaced about the circumference of said ring member.

7. The knock-down kit of claim 6, wherein each of said support elements is elongated and has an end region turnably mounted in said ring member.

8. The knock-down kit of claim 6, wherein each of said support elements is elongated and has an end region receivable with snap-type action in a respective channel.

9. The knock-down kit of claim 6, wherein each of said support elements is elongated and has an end region, and wherein each rib has extension wall portions bounding an auxiliary generally U-shaped channel for receiving therein with snap-type action the end region of a respective support element.

10. The knock-down kit of claim 1, wherein each panel is composed of a plurality of sheet-like materials in overlapping relationship with each other.

11. A knock-down kit for forming a lamp shade, comprising:

(a) a plurality of panels constituted by non-rigid flexible material each having opposed longitudinally-extending side edge regions;

(b) means for snappingly engaging adjacent side edge regions of each two adjacent panels, including a plurality of longitudinally-extending ribs each having a pair of resilient side wall portions and a base wall portion intermediate the latter and bounding a generally U-shaped channel therewith, said wall portions of each rib being resilient and movable away from the other of said wall portions of the respective pair, in response to insertion of a panel side edge region into an associated channel, between a non-clamped position, and a clamped position in which said wall portions of each pair receive therebetween with snap-type closure action a side edge region of one panel and a side edge region of another adjacent panel; and (c) means for supporting said flexible snappingly-engaged panels in a predetermined assembled orientation relative to each other, including a ring member for attaching the lamp shade to a lamp to be shaded, and a plurality of elongated support elements extending radially and spaced equiangularly about said ring member, each support element having one end region turnably mounted in said ring member and another opposite end region receivable in a respective channel with snap-type action.

12. A lamp shade, comprising:

(a) a plurality of panels constituted of bendable flexible material each having opposed longitudinally-extending bent side edge regions which overlap each other;

(b) a plurality of longitudinally-extending ribs for snappingly engaging adjacent side edge regions of each two adjacent panels.

each rib having a pair of wall portions bounding a generally U-shaped channel, at least one of said wall portions of each rib being resilient and movable away from the other of said wall portions of the respective pair, in response to insertion of a panel side edge region into an associated channel, between a non-clamped position, and a clamped position, in which said wall portions of each pair receive therebetween with snap-type closure action a bent side edge region of one panel and a bent overlapped side edge region of another adjacent panel; and (c) a plurality of support elements for supporting said snappingly-engaged panels in a predetermined orientation relative to each other, each support element mountable on a respective rib to thereby form a lamp shade.

* * * * *